US007965050B2

(12) United States Patent
Nieuwlands

(10) Patent No.: US 7,965,050 B2
(45) Date of Patent: Jun. 21, 2011

(54) SELECTIVE CONTROL OF LIGHTING DEVICES

(75) Inventor: Erik Nieuwlands, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 701 days.

(21) Appl. No.: 12/063,301

(22) PCT Filed: Aug. 3, 2006

(86) PCT No.: PCT/IB2006/052678

§ 371 (c)(1),
(2), (4) Date: Feb. 8, 2008

(87) PCT Pub. No.: WO2007/017811

PCT Pub. Date: Feb. 15, 2007

(65) Prior Publication Data

US 2010/0164402 A1 Jul. 1, 2010

(30) Foreign Application Priority Data

Aug. 10, 2005 (EP) ..... 05107345

(51) Int. Cl.
*H05B 37/00* (2006.01)

(52) U.S. Cl. ..... 315/312; 315/316; 315/297; 315/154; 315/159; 340/825.22; 340/825.29

(58) Field of Classification Search ..... 315/312, 315/316, 324, 149–159, 291, 307, 297, 323; 340/531, 533, 538.11, 539.11, 825.22, 825.29
See application file for complete search history.

(56) References Cited

U.S. PATENT DOCUMENTS

| | | | | |
|---|---|---|---|---|
| 5,769,527 | A * | 6/1998 | Taylor et al. | 362/85 |
| 5,838,116 | A | 11/1998 | Katyl | |
| 5,838,226 | A * | 11/1998 | Houggy et al. | 340/310.11 |
| 6,166,496 | A * | 12/2000 | Lys et al. | 315/316 |
| 6,333,605 | B1 | 12/2001 | Grouev | |
| 6,388,399 | B1 * | 5/2002 | Eckel et al. | 315/312 |
| 6,969,954 | B2 * | 11/2005 | Lys | 315/155 |
| 7,446,671 | B2 * | 11/2008 | Giannopoulos et al. | 340/825.72 |
| 7,710,271 | B2 * | 5/2010 | Frumau | 340/572.1 |
| 2002/0043938 | A1 | 4/2002 | Lys | |
| 2004/0032226 | A1 | 2/2004 | Lys | |

FOREIGN PATENT DOCUMENTS

| | | |
|---|---|---|
| DE | 4327173 | 2/1995 |
| WO | 03078894 | 9/2003 |
| WO | 2004057927 | 7/2004 |
| WO | 2006111934 | 10/2006 |

* cited by examiner

*Primary Examiner* — Haissa Philogene

(57) ABSTRACT

In an arrangement of lighting devices (10), a remote control device (30) and a central control device (20), a particular lighting device to be controlled by means of the remote control device may be selected by a user transmitting a selecting command (42, 43). When the central control device receives the selecting command (44), it carries out a selection sequence (45) during which it controls the lighting devices in one or the other sequence so as to have their output change temporarily (45, 46, 47). If the remote control device, which is directed to the particular lighting device (41), senses such an output change (50), it transmits data representing such an event (51) to the central control device. When the central control device receives such event data (52), it determines the particular lighting device as that to which the remote control device is directed (53) for subsequent control (54) of this particular lighting device.

20 Claims, 2 Drawing Sheets

SELECTIVE CONTROL OF LIGHTING DEVICES

FIELD OF THE INVENTION

The invention relates to a method of controlling a particular lighting device in an arrangement of lighting devices.

BACKGROUND OF THE INVENTION

US2004/0032226 discloses a method and a system for automatic configuration of devices, such as lighting devices. The system comprises a remote unit for receiving information from a lighting device, which information uniquely identifies the lighting device. A central controller of the system is capable of assigning an address to the lighting device. A communication link of the system is intended for transmitting said unique information to the controller. To start said configuration, the central controller puts the lighting devices in a program mode, such that all lighting devices transmit their unique hardware serial numbers at the same time by modulating a light output supplied with the respective serial numbers. The remote unit is directed to a particular lighting device so as to receive the modulated light output from this device. The remote unit transmits the serial number which was supplied with the received modulated light. When the central controller has received the serial number, it associates a system address with this serial number and transmits the system address to the lighting device having said hardware serial number. The lighting device stores the received system address. During normal operation of the system, i.e. not in the configuration mode, the lighting devices, if addressed by their system address, will respond to commands from the central controller.

The remote unit of the prior-art system is not suitable for transmitting commands controlling a particular lighting device during normal operation of the system. If they do not operate in the configuration mode, the lighting devices do not supply an output which is modulated by any information.

OBJECT OF THE INVENTION

It is an object of the invention to alter the prior-art method and system in such a way that, after the system has been configured, a user can choose and control a particular lighting device without the need for obtaining an identifier, which identifies the particular lighting device, from the particular lighting system.

SUMMARY OF THE INVENTION

The above object of the invention is achieved by providing a method that provides the possibility of using the remote control device for selectively controlling all lighting devices of the arrangement without the requirement of gaining, holding, and transmitting identifiers of the lighting devices.

In accordance with said method, the object of the invention is also achieved by providing a lighting arrangement, a lighting device, a remote control device and a central control device.

BRIEF DESCRIPTION OF THE DRAWINGS

These and other aspects of the invention are apparent from and will be elucidated with reference to the embodiments described hereinafter.

In the drawings.

DESCRIPTION OF EMBODIMENTS

Figure 1:
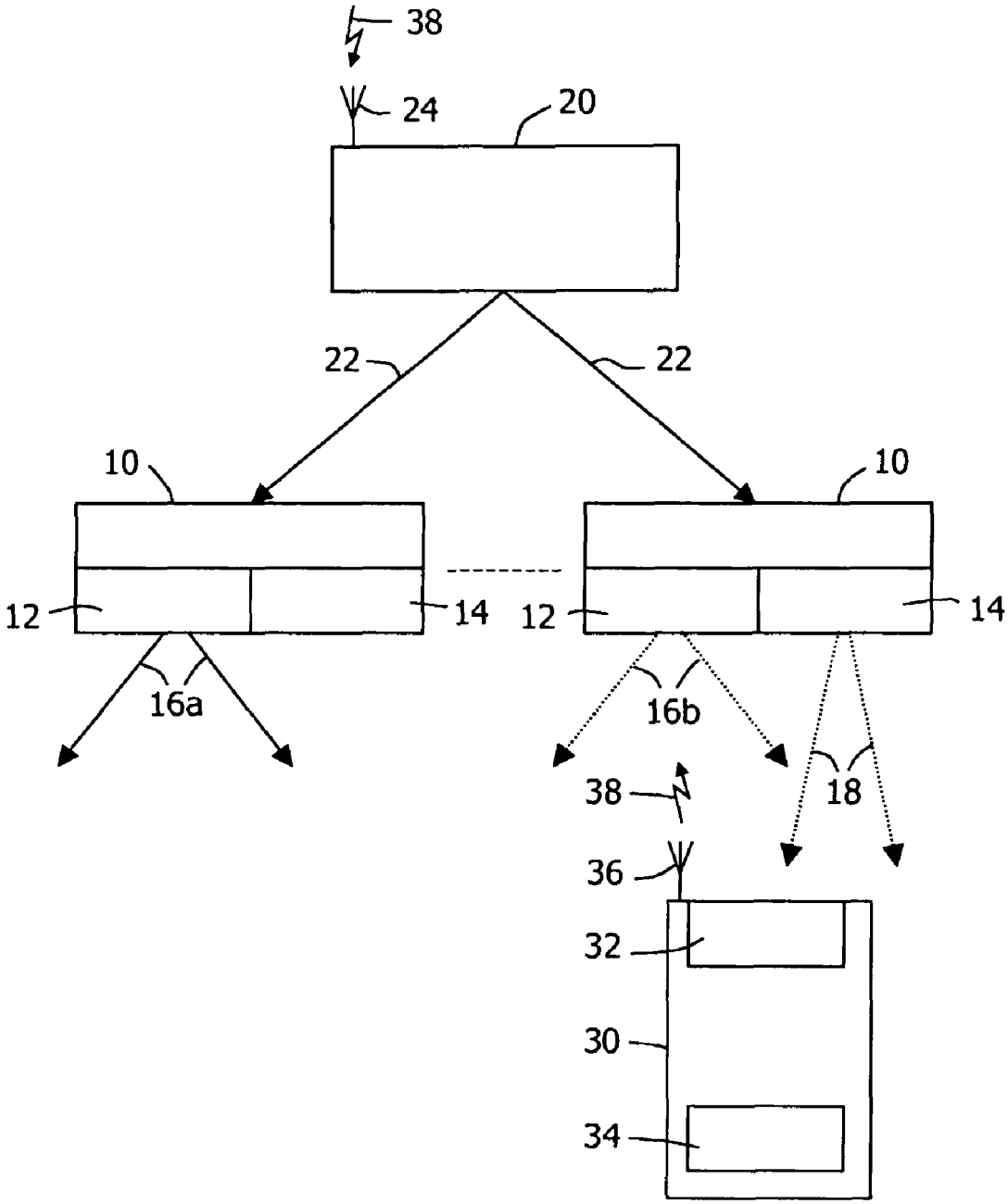
FIG. 1 is a diagram of a lighting arrangement according to the invention.

The lighting arrangement as illustrated in FIG. 1 comprises a plurality of lighting devices 10, a central control device 20 and a remote control device 30.

The lighting devices 10 do not need to be identical. They may accommodate lamps 12 of different types, such as gas discharge lamps, LED lamps or incandescent lamps. The lighting devices 10 may also be equipped with signaling members 14, such as LEDs and sound generators. For simplicity of the drawing, the signaling member 14 in FIG. 1 is indicated as a LED.

If ignited, a lamp 12 may output light, as indicated by arrows 16 (16*a* and 16*b*). A continuous light output from a lamp 12 is indicated by solid arrows 16*a*. A modulated, possibly discontinuous, light output from a lamp 12 is indicated by dotted arrows 16*b*. No output or no detectable output from a LED 14 is not indicated. A detectable output, possibly modulated or discontinuous, from a LED 14 is indicated by dotted arrows 18.

The central control device 20 may communicate selectively with each lighting device 10 (or a group of lighting devices at a time) through a communication channel 22. The communication channel 22 may be of any type, such as a wireless connection, a modulation of a mains voltage for the lighting devices 10, or a special wire data link. The central control device 20 may send commands through the communication channels 22 to selectively control states of the lighting devices, for example, the intensity of the output provided by their lamps 12 and/or their signaling members 14 (if applied).

The central control device 20 further comprises a radio frequency (RF) receiver (not shown), which is connected to an antenna 24, the use of which will be described hereinafter.

The remote control device 30 may be a handheld device. It has at least one sensor 32 which, when properly oriented with respect to outputs 16, 18, is suitable for sensing said outputs 16, 18 from a lighting device 10.

The remote control device 30 further comprises means which may be operated by a user and are indicated for simplicity as keys 34.

The remote control device 30 also comprises a RF transmitter (not shown), which is connected to an antenna 36 for possibly transmitting a RF signal 38, which conveys data generated by the remote control device 30. The RF signal 38 is suitable to be received and processed by the antenna 24 and receiver of the central control device 20.

Instead of a RF link for a RF signal 38, a different type of communication or any combination of different types of communication may be used. For example, a room in which the remote control device 30 is to be used has an infrared receiver attached to one of its walls or its ceiling, which receiver is capable of receiving an infrared signal instead of RF signal 38 from the remote control device 30. Said infrared receiver may be connected by wire to the central control device 20.

Figure 2:
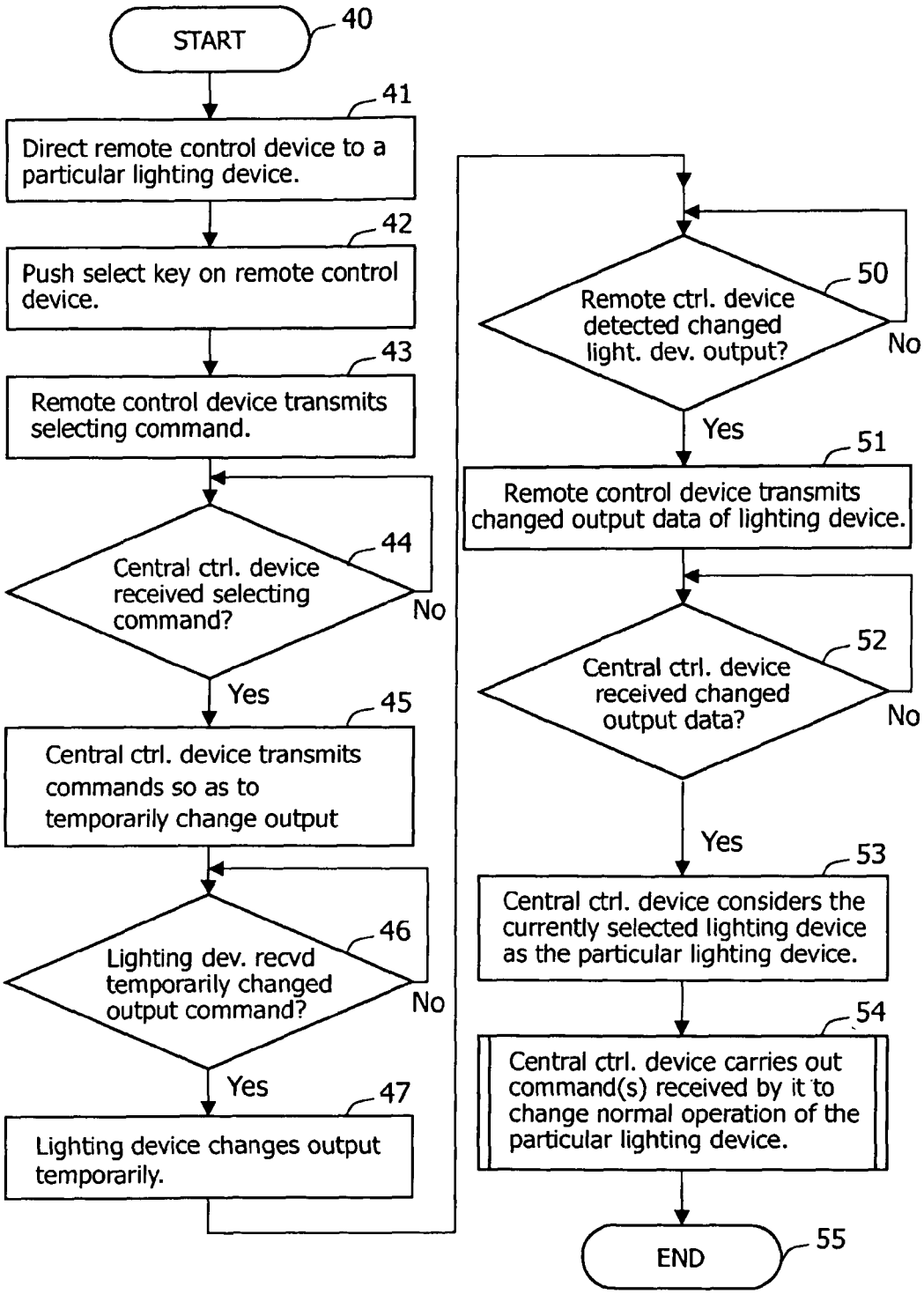
FIG. 2 is a flow chart of user operation steps of controlling a lighting device of the arrangement shown in FIG. 1.

The operation of the arrangement in the case of user control of a particular lighting device 10 (or group of lighting devices including said particular lighting device 10) will now be described with reference to the flow chart of FIG. 2.

From a state of normal operation of the arrangement (indicated by step 40), the user directs the remote control device 30 to a particular lighting device 10, i.e. a lighting device 10 which the user wants to control (step 41). More specifically, the user must orient the sensor 32 of the remote control device 30, such that the sensor 32 may sense an output from the particular lighting device. Dependent on the specific construction of the lighting device, said output is an output 16 from a lamp 12 and/or an output 18 from a signaling member 14.

Subsequently, the user operates one of the keys 34 of the remote control device 30 (step 42) by which the remote control device 30 will transmit the RF signal 38 conveying data, i.e. a selecting command, indicating upon its reception that a user of a remote control device 30 wants to control one or the other lighting device 10 (step 43).

When the central control device 20 receives a selection command (step 44), it starts a selection sequence during which it transmits commands through channels 22 to all lighting devices 10 so as to temporarily change their output 16, 18 (step 45).

The central control device 20 transmits the temporarily changed output commands to one lighting device 10 at a time or to different groups of lighting devices 10 at a time.

When a lighting device 10 receives a temporarily changed output command (step 46), it temporarily changes its output (from no output or a continuous output (16*a*) to a modulated, possibly discontinuous output (16*b*, 18)) (step 47).

When the remote control device 30 detects such a change of output from the lighting device 10 to which its sensor 32 is directed (step 50), it transmits the RF signal 38, which now conveys data indicating upon its reception that a remote control device 30 has detected a change of output from a lighting device 10 (step 51).

Since steps 42 to 51 occur almost simultaneously, a response to a temporarily changed output command transmitted to a particular lighting device indicates that the user directed the remote control device to this particular lighting device 10.

Therefore, when the central control device 20 receives data indicating a change of lighting device output 16, 18 (step 52), it considers the lighting device 10 to which it has just transmitted the changed output command as the particular lighting device 10 that the user wants to control (step 53).

Subsequently, the central control device 20 may abort the selection sequence and, until it receives the next selection command, may handle any command from the remote control device 30 as a command for controlling said particular lighting device 10 accordingly, such as a command for turning on or off, dimming, panning, rotating and changing color (step 54). In fact, the user-operated key by which the remote control device 30 transmitted a selecting command may itself be a command for controlling the particular lighting device 10. Alternatively, any operation of a key of the remote control device 30 may initiate a selection sequence by the central control device 20 so as to first find or select the particular lighting device 10 to which the user directs the remote control device 30 before actually executing a lighting device control command associated with the operated key.

In the arrangement according to the invention, communication between a lighting device 10 and the remote control device is to the remote control device 30 only. Furthermore, the central control device 20 does not require the remote control device 30 to acquire an address of a particular lighting device 10 so as to control this device. Consequently, the arrangement may be manufactured, installed and maintained at relatively low cost, while it has a high capacity for selectively controlling lighting devices 10. In fact, if all lighting devices 10 are connected through individual mains cables to respective (electronic) drivers of the central control device 20, the arrangement will not need addressing of the lighting devices 10 through communication channels 22 at all, but the method according to the invention can still be applied.

It is to be noted that the use of a signaling member 14, such as a LED, and the response of such a signaling member to only a changed output command from the central control device 20 may be advantageous, because the output of the signaling member 14 may have much shorter rise and fall times than an output of a lamp 12. In that case, a change of output from a lighting device 10 may be minimally annoying to persons in a room in which the particular lighting device 10 is arranged, and the selection sequence may be carried out in a short time, in which the central control device 20 almost instantaneously detects the particular lighting device 10 when a (selection) key on the remote control device 30 is operated. It is also to be noted that the particular lighting device 10 can be detected by the central control device 20 within a shorter time by applying a binary method of transmitting a changed output command to different groups of lighting devices 10 in the sequence. For example, in an arrangement of 1024 lighting devices 10, the central control device 20 needs to transmit a changed output command only ten times so as to detect the particular lighting device.

It is further to be noted that a change of output from a lighting device 10 may be anything that is detectable by the remote control device 30, such as a single event or a sequence of events of turning on/off (or off/on) the lamp 12 and/or the signaling member 14.

The invention claimed is:

1. A method of controlling a particular lighting device in a lighting arrangement comprising a plurality of lighting devices, a central control device and a remote control device, the method comprising the steps of:

directing the remote control device to the particular lighting device, such that the remote control device can detect an output supplied by said particular lighting device;

transmitting changed output data of the lighting device by the remote control device, when said remote control device has detected a change of the output from the lighting device;

transmitting operation-determinative data by the central control device when said central control device has received changed output data of the lighting device;

changing a state of the particular lighting device when said particular lighting device has received operation-determinative data;

wherein the user transmits a selecting command by the remote control device when the user wants to control the particular lighting device, the central control device enters a selection sequence when it has received said selecting command, during which sequence said central control device transmits operation-determinative data to lighting devices selected in a sequence by the central control device so as to temporarily change their output, and the central control device determines the particular lighting device from changed output data of the lighting device, which data has been received during the selection sequence for subsequently controlling said particular lighting device.

2. A method according to claim 1, wherein the selection sequence is of the binary type, such that different combinations of lighting devices are selected and not selected at different times during execution of the sequence, and the central control device determines the particular lighting device from changed output data of the lighting device, which data has been received at said different times during the selection sequence.

3. A method according to claim 1, wherein, if the particular lighting device is determined in the selection sequence, the central control device carries out a normal operation change command received from the remote control device for controlling the particular lighting device so as to change its normal operation.

4. A method according to claim 3, wherein the remote control device transmits the normal operation change command together with the selecting command.

5. A method according to claim 1, wherein the output from a lighting device to be detected by the remote control device is a light output from a lamp of the lighting device.

6. A method according to claim 1, wherein the output from a lighting device to be detected by the remote control device is an output from a signaling member of the lighting device.

7. A method according to claim 2, wherein the output from a lighting device to be detected by the remote control device is an output from a signaling member of the lighting device.

8. A method according to claim 3, wherein the output from a lighting device to be detected by the remote control device is an output from a signaling member of the lighting device.

9. A method according to claim 4, wherein the output from a lighting device to be detected by the remote control device is an output from a signaling member of the lighting device.

10. A method according to claim 5, wherein the output from a lighting device to be detected by the remote control device is an output from a signaling member of the lighting device.

11. A method according to claim 2, wherein, if the particular lighting device is determined in the selection sequence, the central control device carries out a normal operation change command received from the remote control device for controlling the particular lighting device so as to change its normal operation.

12. A method according to claim 11, wherein the remote control device transmits the normal operation change command together with the selecting command.

13. A method according to claim 12, wherein the output from a lighting device to be detected by the remote control device is a light output from a lamp of the lighting device.

14. A method according to claim 2, wherein the output from a lighting device to be detected by the remote control device is a light output from a lamp of the lighting device.

15. A method according to claim 3, wherein the output from a lighting device to be detected by the remote control device is a light output from a lamp of the lighting device.

16. A method according to claim 4, wherein the output from a lighting device to be detected by the remote control device is a light output from a lamp of the lighting device.

17. A lighting arrangement comprising a plurality of lighting devices, a central control device and a remote control device, the remote control device having a sensor for sensing an output supplied by a particular lighting device, user-operable elements for transmitting data about a change of said output, said central control device being configured to transmit operation-determinative data when it has received changed output data from the lighting device, and said particular lighting device being configured to change its state when it has received operation-determinative data, wherein the remote control device is suitable for transmitting a selecting command by proper operation of the user-operable means, the central control device is suitable for carrying out a selection sequence when it has received said selecting command, during which sequence said central control device transmits operation-determinative data to lighting devices selected in a sequence by the central control device so as to temporarily change their output, and the central control device is suitable for determining the particular lighting device from changed output data of the lighting device, which data has been received during the selection sequence for subsequently controlling said particular lighting device.

18. A lighting device of a lighting arrangement comprising a plurality of lighting devices, a central control device and a remote control device, the remote control device having a sensor for sensing an output supplied by a particular lighting device, user-operable elements for transmitting data about a change of said output, said central control device being configured to transmit operation-determinative data when it has received changed output data from the lighting device, and said particular lighting device being configured to change its state when it has received operation-determinative data, wherein, apart from a lamp, the lighting device comprises a signaling member that is arranged to supply the output to be sensed by the remote control device and to change its output when it has received operation-determinative data from the central control device.

19. A remote control device of a lighting arrangement, comprising a plurality of lighting devices and a central control device, the remote control device having a sensor for sensing an output supplied by a particular lighting device, user-operable elements for transmitting data about a change of said output, said central control device being configured to transmit operation-determinative data when it has received changed output data from the lighting device, and said particular lighting device being configured to change its state when it has received operation-determinative data, wherein the user-operable elements are suitable for transmitting a selecting command to the central control device that causes the central control device to initiate a sequence that facilitates selection of the particular lighting device from among other lighting devices controlled by the central control device.

20. A central control device of a lighting arrangement, comprising a plurality of lighting devices and a remote control device, the remote control device having a sensor for sensing an output supplied by a particular lighting device, user-operable elements for transmitting data about a change of said output, said central control device being configured to transmit operation-determinative data when it has received changed output data from the lighting device, and said particular lighting device being configured to change its state when it has received operation-determinative data, wherein the central control device is suitable for carrying out a selection sequence when it has received a selecting command from the remote control device, during which sequence said central control device transmits operation-determinative data to lighting devices selected in a sequence by the central control device so as to temporarily change their output, and the central control device is suitable for determining the particular lighting device from changed output data of the lighting device, which data has been received during the selection sequence for subsequently controlling said particular lighting device.

* * * * *